US011819870B2

(12) United States Patent
Harrison

(10) Patent No.: US 11,819,870 B2
(45) Date of Patent: Nov. 21, 2023

(54) SYSTEM AND METHOD FOR EFFICIENT AND ERGONOMIC WATERPROOFING OF JOINTS AND FASTENERS

(71) Applicant: William Harrison, Cedartown, GA (US)

(72) Inventor: William Harrison, Cedartown, GA (US)

( * ) Notice: Subject to any disclaimer, the term of this patent is extended or adjusted under 35 U.S.C. 154(b) by 845 days.

(21) Appl. No.: 16/804,229

(22) Filed: Feb. 28, 2020

(65) Prior Publication Data

US 2020/0276601 A1 Sep. 3, 2020

Related U.S. Application Data

(60) Provisional application No. 62/812,414, filed on Mar. 1, 2019.

(51) Int. Cl.

| | |
|---|---|
| ***B05B 9/01*** | (2006.01) |
| ***E04B 1/64*** | (2006.01) |
| ***B05B 1/02*** | (2006.01) |
| ***B05B 9/04*** | (2006.01) |
| ***B05C 5/02*** | (2006.01) |
| ***E04D 3/38*** | (2006.01) |

(52) U.S. Cl.

CPC ..... *B05B 9/01* (2013.01); *B05B 1/02* (2013.01); *B05B 9/0413* (2013.01); *B05C 5/02* (2013.01); *E04B 1/642* (2013.01); *E04B 1/648* (2013.01); *E04D 3/38* (2013.01)

(58) Field of Classification Search

None

See application file for complete search history.

(56) References Cited

U.S. PATENT DOCUMENTS

| | | | | |
|---|---|---|---|---|
| 2,936,959 | A * | 5/1960 | Nord | B05B 9/01 239/602 |
| 3,058,632 | A | 10/1962 | Stremmel | |
| 3,163,360 | A * | 12/1964 | McNinch, Jr. | B05B 9/01 91/325 |
| 3,179,341 | A * | 4/1965 | Plos | E04F 21/12 239/311 |
| 3,181,798 | A * | 5/1965 | Williams | B05B 15/62 239/487 |

(Continued)

*Primary Examiner* — Jethro M. Pence

(74) *Attorney, Agent, or Firm* — Richard C. Piercy, Esq.; Grell & Watson Patent Attorneys LLC

(57) ABSTRACT

A system for efficiently and ergonomically waterproofing a weakness area of a roof. The system includes an airless sprayer system capable of attaching to one or more attachments. The airless sprayer system is connected to a reservoir containing a waterproofing liquid. The attachments include an encapsulating attachment and a duckbilled attachment, either attachment capable of connecting to an extending wand. The system may be used atop a roof by either placing the encapsulating attachment over a fastener or the duckbilled end over a seam and pulling the trigger of a spray gun of the airless sprayer system until either the fastener or seam are sufficiently covered in waterproofing liquid. By connecting the wand therebetween the spray gun and the attachment, the user of the system may be able to remain standing when applying the waterproofing liquid. A method for efficiently and ergonomically waterproofing a roof weakness using the system.

16 Claims, 7 Drawing Sheets

(56) References Cited

U.S. PATENT DOCUMENTS 3,198,439 A * 8/1965 McNinch, Jr. ..... B05B 9/01 91/243
3,208,673 A * 9/1965 Kautz ..... B05B 7/0483 239/289
3,219,279 A * 11/1965 Peeps ..... B05B 1/3046 222/401
3,362,644 A * 1/1968 Parke ..... B05B 1/3046 239/553
3,380,705 A * 4/1968 Enssle ..... B05B 9/01 251/294
3,469,788 A * 9/1969 Glaros ..... B05B 9/04 222/399
3,512,684 A 5/1970 Sutton
3,515,355 A * 6/1970 Wagner ..... B05B 1/14 239/526
3,589,621 A * 6/1971 Bradley ..... B05B 9/01 239/526
3,659,787 A * 5/1972 Ito ..... B05B 1/02 239/599
3,700,174 A * 10/1972 Beck ..... B05B 15/656 239/526
3,726,440 A 4/1973 Deeb
3,780,953 A * 12/1973 Malec ..... B05B 9/01 251/98
3,785,852 A * 1/1974 Schleidt ..... C08L 95/00 516/46
3,844,487 A * 10/1974 Malec ..... B05B 9/01 239/526
3,913,844 A * 10/1975 Petrovic ..... B05B 15/00 239/526
3,963,180 A * 6/1976 Wagner ..... B05B 9/01 239/288.5
4,005,824 A * 2/1977 Becker ..... B05B 7/1209 239/289
4,025,045 A * 5/1977 Kubiak ..... B05B 9/01 239/599
4,166,579 A * 9/1979 Beise ..... B05B 12/0026 239/526
4,225,087 A * 9/1980 Lawlor ..... B05B 12/0026 251/109
4,287,242 A * 9/1981 Monden ..... C08L 95/005 427/427.4
4,323,196 A * 4/1982 Logue ..... B05B 15/62 239/587.5
4,344,991 A * 8/1982 Gray ..... B05D 1/02 427/325
4,361,283 A * 11/1982 Hetherington ..... B05B 7/08 239/113
4,516,725 A * 5/1985 Cavanaugh ..... B05B 12/14 239/305
4,518,121 A * 5/1985 Smith ..... E01C 23/166 239/150
4,598,871 A * 7/1986 Hartle ..... B05B 5/0531 118/629
4,637,551 A * 1/1987 Seeger, Jr. ..... B05B 15/16 239/288.5
4,702,420 A * 10/1987 Rath ..... B05B 9/01 239/391
4,745,011 A * 5/1988 Fukuta ..... B01F 23/49 239/110
4,824,017 A * 4/1989 Mansfield ..... B29B 7/7452 239/296
4,928,882 A * 5/1990 Awano ..... B05B 9/01 239/112
4,934,565 A 6/1990 Heisey et al.
4,967,956 A * 11/1990 Mansfield ..... B05B 7/06 239/296
4,971,745 A 11/1990 Ferenc et al.
5,189,751 A * 3/1993 Giuliani ..... A61C 17/32 310/36
5,201,953 A * 4/1993 Lowry ..... B05B 13/005 239/149
5,217,238 A * 6/1993 Cyphers ..... B05B 9/0403 D34/24
5,303,865 A * 4/1994 Bert ..... B05B 7/0815 239/428
5,322,381 A 6/1994 Argo, II
5,443,211 A * 8/1995 Young ..... E04F 21/12 239/581.1
5,671,889 A * 9/1997 Petty ..... B05B 7/0846 239/588
5,897,061 A * 4/1999 Petty ..... B05B 12/00 239/304
5,900,061 A * 5/1999 Wright ..... E04D 15/07 222/382
5,927,609 A * 7/1999 Scarpa ..... B05B 7/1431 239/290
5,985,366 A * 11/1999 Wright ..... E04D 7/00 427/407.1
6,041,976 A 3/2000 Robertson
6,060,555 A * 5/2000 Wright ..... B05B 7/2489 524/427
6,276,616 B1 * 8/2001 Jenkins ..... B05B 9/01 239/526
6,347,752 B1 * 2/2002 Davidson ..... B05B 15/68 239/600
6,454,136 B1 9/2002 Evans
6,460,787 B1 * 10/2002 Hartle ..... B05B 7/1263 239/691
6,502,763 B1 * 1/2003 McCann ..... B05B 1/1672 239/119
6,520,190 B2 * 2/2003 Thompson ..... B08B 9/0321 134/22.12
6,533,189 B2 * 3/2003 Kott ..... B05B 7/0861 239/303
6,616,069 B1 * 9/2003 Jou ..... B05B 7/0433 239/DIG. 21
6,626,380 B1 * 9/2003 Williams ..... B05B 9/0861 239/375
6,877,681 B2 * 4/2005 Hartle ..... B05B 7/066 239/708
6,905,084 B2 * 6/2005 Hammarth ..... B05B 9/0805 239/574
7,178,740 B2 * 2/2007 Williams ..... B05B 7/0846 239/10
7,216,816 B2 * 5/2007 Hammarth ..... C09K 3/30 239/525
8,360,345 B2 * 1/2013 Micheli ..... B05B 9/01 251/231
8,561,848 B2 10/2013 Gardner
8,562,888 B2 10/2013 Kelley et al.
8,616,868 B2 12/2013 Hutter, III et al.
8,863,458 B2 * 10/2014 Noonan ..... E04B 1/7604 52/407.3
8,919,278 B2 * 12/2014 Smith ..... E04D 7/00 118/316
8,940,382 B2 * 1/2015 Smith ..... B05D 1/02 106/14.05
8,991,662 B2 3/2015 Milan
9,333,527 B2 5/2016 Jurado Blazquez
9,394,655 B1 * 7/2016 Wright, Jr. ..... E01C 23/163
9,764,371 B2 9/2017 Fujimoto et al.
9,849,637 B2 12/2017 Pajel et al.
10,035,287 B2 7/2018 Song
10,207,289 B2 * 2/2019 Smith ..... B05D 3/007
10,940,498 B2 * 3/2021 Fideler ..... B05B 15/62
11,052,418 B2 * 7/2021 Olson ..... B05B 9/0861
11,059,062 B2 * 7/2021 Adams ..... B05B 1/3046
11,534,788 B2 * 12/2022 Luth ..... C09D 7/20
2005/0189445 A1 * 9/2005 Hartle ..... B05B 7/1209 239/290
2006/0081725 A1 * 4/2006 Plager ..... B05B 9/01 239/526
2007/0186813 A1 * 8/2007 Smith ..... B05B 7/24 524/60
2008/0296410 A1 * 12/2008 Carey ..... B05B 15/40 29/890.07
2009/0217868 A1 9/2009 Caseteuble

(56) References Cited

U.S. PATENT DOCUMENTS

| | | | | |
|---|---|---|---|---|
| 2010/0077959 | A1* | 4/2010 | Treloar | G09B 11/10 118/682 |
| 2015/0217312 | A1* | 8/2015 | Hines | B05B 11/1016 222/333 |
| 2016/0153186 | A1* | 6/2016 | Noonan | E04B 1/7654 52/404.1 |
| 2016/0354803 | A1* | 12/2016 | Smith | E04D 15/00 |
| 2017/0073963 | A1* | 3/2017 | Noonan | E04B 1/7658 |
| 2017/0203314 | A1* | 7/2017 | Rose | B05B 7/1209 |
| 2017/0304969 | A1 | 10/2017 | Hoshino et al. | |
| 2018/0050361 | A1* | 2/2018 | Gehrung | B05B 12/0026 |
| 2019/0193108 | A1* | 6/2019 | Smith | E04D 7/00 |
| 2020/0254481 | A1* | 8/2020 | Farrell | B05B 12/002 |
| 2021/0046492 | A1* | 2/2021 | Becker | B05B 15/63 |
| 2021/0123240 | A1* | 4/2021 | Yu | B05B 7/0093 |
| 2021/0220858 | A1* | 7/2021 | Keutzer | F16M 13/02 |
| 2021/0220859 | A1* | 7/2021 | Keutzer | B25H 3/06 |
| 2021/0308712 | A1* | 10/2021 | Olson | B05C 1/0813 |
| 2021/0331188 | A1* | 10/2021 | Adams | B05B 12/002 |
| 2022/0088629 | A1* | 3/2022 | Andersen | B05B 9/01 |

* cited by examiner

SYSTEM AND METHOD FOR EFFICIENT AND ERGONOMIC WATERPROOFING OF JOINTS AND FASTENERS

CROSS-REFERENCE TO RELATED APPLICATIONS

To the full extent permitted by law, the present United States Non-provisional patent Application hereby claims priority to and the full benefit of, United States Provisional application entitled "SYSTEM AND METHOD FOR EFFICIENTLY AND ERGONOMICALLY APPLYING WATERPROOFING MATERIAL TO METAL ROOF FASTENERS," having assigned Ser. No. 62/812,414, filed on Mar. 1, 2019, which is incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure generally relates to spraying apparatuses, namely improved apparatuses and systems for applying liquids or other fluent materials to surfaces by spraying. More particularly, the instant disclosure relates to systems which include nozzles specially adapted for application of waterproofing liquids to joints and fasteners of exposed metal roofing and the corresponding methods of use of the systems.

Description of the Related Art

Industrial, commercial, and residential roofs often comprise a series of metal sheets which are designed to be joined together along the entire top structure of a building so as to prevent the intrusion of water into the structure during weather events, among other reasons for roofing structures like temperature control, safety, and aesthetics. While each metal sheet generally sufficiently shields its respective area from the elements, points or areas of weakness exist along joints between sheets and at individual points where either the joints are fastened or the sheet is fastened to the corresponding structure. Each of these points or areas of weakness may allow for the eventual intrusion by running or standing water on the roof, thereby causing a leak into the internal structure which may then cause damage to internal building elements not designed to be exposed to water. Furthermore, depending on the composition of the metal sheets and any fasteners used to join and secure the sheets, rainwater and the dissolved solids and chemicals it may contain may slowly degrade or rust a roof over time, thereby causing additional areas for water intrusion at existing or new points or areas of weakness. For example, while the exposed surface of a metal sheet may be durable against persistent rains or standing water, constant exposure to these elements at an exposed joint line, at a fastener, or at a drilled hole for a fastener may not be sufficiently durable. Finally, slow or sudden movement of the structure of a building may cause fasteners on a metal roof to become loosened suddenly or over time, again increasing the number of points or areas of weakness for water to intrude into the building.

Various devices and systems, and methods of using these devices and systems, exist to prevent the intrusion of water into these points and areas of weakness of a metal roof, often involving the application of waterproofing liquid and/or waterproofing materials. These materials, devices, systems and methods of use may exist in various forms and are included herein by way of example and not limitation. One example may be the application of a liquid polymer or other waterproofing liquid to the entire roof surface which is left to dry and thereby forming a continuous waterproof barrier over the entire surface of the roof. Another example may be the application of a vinyl sheet shaped to fit over the roof or areas of the roof creating a similar barrier against water exposure to the metal. Yet another example may be the application of liquid waterproofing material that is applied to vulnerable areas (joints, fasteners, etc.) with a brush or caulk gun while wet and allowed to dry, thereby forming a waterproof barrier at suitable points of weakness along the surface of the roof. Each of these methods may have benefits and weaknesses, the trade-offs of which are covered in more detail below.

As mentioned above, a first example method for waterproofing a metal roof may be the application of a liquid polymer or other waterproofing liquid to the entire roof surface which is left to dry and thereby forming a continuous waterproof barrier over the entire surface of the roof. The application of a liquid polymer or other waterproofing liquid to the entire surface of a roof may be accomplished through a variety of means, including but not limited to spraying and brushing. A major benefit of applying a liquid polymer or other waterproofing liquid to the entire surface of a roof may be that few remaining points or areas may exist after a thorough application. Depending on the thickness of such an application, it may increase the durability and overall life of a metal roof and may provide other additional benefits against wear (e.g. prevent scratching of metal surface, decrease adherence of environmental debris). However, this method may be both labor intensive and expensive. Waterproof coatings may be costly by-volume and covering the entire roof with one or more coats of a costly coating may be cost-prohibitive for many applications and budgets. Furthermore, coating an entire roof with one or more coats of waterproofing material may be burdensome from a labor perspective, and possibly even dangerous. A person or crew standing upon a roof in hot or otherwise inclement weather may experience fatigue or even symptoms from exposure to the vapors released as the coating dries. This may be exacerbated when a thin coating must be applied to the entire roof's surface. Finally, during application, a laborer or crew may need to be careful not to coat themselves into a corner, thereby possibly necessitating comprehensive planning for where and how to cover the entire roof with the coating.

A second example method for waterproofing a metal roof example may be the application of a vinyl sheet shaped to fit over the roof or areas of the roof creating a similar barrier against water exposure to the metal. A vinyl sheet may be comprised of one or many sheets of unrolled vinyl rolls. In applications with many sheets, they may each overlap and be adhered to one another. In most instances, the vinyl sheets may be adhered to the roof using a glue, resin, epoxy, or other type of coating. Other varieties may include self-adhering or peel-and-stick vinyl sheets. While implementing this technique may offer more durable and aesthetically pleasing results than the first method, it may require more skilled labor in its application and may prove to be both more costly and more labor intensive. Since the vinyl may be required to be attached to the roof through adherence, the baseline labor required by the first method, along with the expense of the coating or adherence material, may be in addition to actually applying the sheets of vinyl. Additionally, where a coating of waterproofing material may form a single, continuous coating over the roof, gaps and wrinkles of the vinyl sheets may introduce concerns with respect to longevity.

A third example method for waterproofing a metal roof may be the application of liquid waterproofing material that is applied to vulnerable areas (joints, fasteners, etc.) with a brush/roller, sprayer or caulk gun while wet and allowed to dry, thereby forming a waterproof barrier at suitable points of weakness along the surface of the roof. These points of weakness may include, by way of example and not limitation, joints and fasteners. Joints may exist where two panels of metal, panels of metal corrugated roofing, or at least two roofing sections meet and fasteners may be used to secure the roofing to the upper surface of a building. Beneath the fasteners usually may exist a hole produced either at the time of manufacture, drilled during instillation, or caused by a self-drilling and/or self-tapping fastener installation. By covering only those areas of a roof which may be most susceptible to weather wear (e.g. at joints and fasteners), there may exist a potential to save costs on materials. Additionally, since fewer square footage may be required to apply such a technique, it stands to reason that labor may be more efficiently used over needing to coat the entire surface. Yet another benefit of this technique may be the potential to cover these susceptible areas with a larger amount of waterproof coating, thereby improving the longevity of the roof. However, various inefficiencies or inadequacies which may require more labor than would be necessary with the ideal equipment. Rolling or brushing the material may offer the benefits of control and precision. However, dipping brushes into waterproofing material reservoirs (e.g. buckets) may require a laborer to either carry the reservoir around the roof as they apply the coating or may require having to travel back and forth to the bucket to replenish the brush. The same may be true with a roller technique. This may prove exhausting or even dangerous, depending on a number of factors including roof size, roof pitch, weather, the like, and combinations thereof. Through use of a sprayer, such as an airless sprayer typically used to paint, a long hose from the reservoir to the sprayer and from the sprayer to the gun may have advantages over a brush/roller technique, thereby preventing the need to travel to and from the reservoir during a longer period of time. However, the use of a sprayer may be less accurate, may require more expensive equipment that requires maintenance, may be more dangerous during transport of heavy equipment to a roof, and may introduce other hazards such as inhalation of overspray and/or volatile fumes. The third technique, application using a caulking gun, may offer the benefits of increased precision with the downside of low volume in comparison with a sprayer technique. For example, through use of a caulking gun loaded with waterproofing material, a laborer may apply a small amount, or a dollop, of waterproofing material to each fastener head and a more liberal amount along a joint of a roof. This may be accomplished through use of a caulking gun having a specialized attachment threaded to the end of the caulking gun or through precise pulls on the gun's trigger. However, the reservoir contained in most caulking guns may be insufficient for most industrial and commercial roofing application, thereby requiring frequent reloading or refilling and decreasing efficiency. Furthermore, a caulking gun may require a laborer to constantly crouch or bend over to apply to a fastener head or joint.

Therefore, it is readily apparent that there is a recognized unmet need for a system and method for efficient and ergonomic application of waterproofing material to a roofing surface joints and fasteners. The instant disclosure is designed to address at least some aspects of the problems discussed above. The system and methods described herein may be designed to replace the above systems and methods, and may also be used alongside or in combination with them.

SUMMARY

Briefly described, in a possibly preferred embodiment, the present disclosure overcomes the above-mentioned disadvantages and meets the recognized need for such a system by providing one or more specialized removable attachments for use with an airless sprayer system. The system as disclosed herein may be adjusted or lengthened and/or used in conjunction with a wand extension between the sprayer gun and the specialized tip(s). By combining these functions, the system and method is more versatile and convenient. Further enhancing the convenient nature of the invention, the system disclosed herein may be disassembled where it may be used in other applications (e.g. painting), easily transported or stored, and cleaned.

In one aspect, the waterproofing system described herein may generally include an airless sprayer system. The airless sprayer system may generally include a piston pump, a motor and drive system which may provide power to the piston pump, a pressure control dial which may adjust the overall pressure on the system, a manifold filter which may filter solid debris to prevent it from entering the fluid system, a one or more fluid hose connected to a reservoir on an inlet side of the airless sprayer system and/or connected to an outlet side of the airless sprayer system, and a spray gun which may be connected to the fluid hose from the outlet side and have a trigger allowing for release of fluid through and out the system. The fluid hose may connect to a reservoir containing a fluid, namely a waterproofing liquid. The motor and drive system may power the airless sprayer system through electricity and/or fuel combustion.

In another aspect, the waterproofing system described herein may optionally include an encapsulating attachment having a substantially cylindrical cavity end and a connection end. The connection end may connect to an airless sprayer system having a spray gun. The cavity end having the substantially cylindrical shape may be of sufficient internal diameter to fully surround a fastener of a metal roof such that when placed directly above the fastener, the outer portion of the cavity contacts the metal roof. When a trigger of the spray gun is pulled, the airless system may release waterproofing liquid through and out the system, thereby filling the cavity end and surrounding the fastener head with waterproofing liquid.

In yet another aspect, the waterproofing system described herein may optionally include a duckbilled attachment having a substantially rectangular cavity end and a connection end. Such an attachment may be suitable when a weakness area of a roof is a seam wherein two metal panels meet and/or overlap along the upper surface of a building. The duckbilled attachment may have a cavity end having the substantially rectangular shape. In use, the duckbilled attachment may be secured to an end of the spray gun of the airless sprayer system. The duckbilled attachment may then be placed upon the seam, then the trigger of the spray gun may be pulled, and may be dragged along the seam prior to releasing said trigger, thereby covering a broad area along each side of the seam with waterproofing liquid. In an optional embodiment of this method, a brush and/or roller may be run across the waterproofing liquid before it is allowed to dry, thereby further enhancing the amount of coverage along each side of the seam, increasing the uniformity of the coating of waterproofing liquid, and/or increasing the aesthetic appeal of the final product.

One feature of the system described herein, may be that in select embodiment of the disclosed system, one or more components may be removed from the system and the system may be capable of full disassembly by the end-user for thorough cleaning of the fluid side of the system. In these select embodiments, the airless sprayer system may be more versatile and capable of performing other tasks, by way of example and not limitation, such as spray painting. The attachment components may be removed from the system and/or sold separately and may be stored in a carrying/storage case when not in use or may be stored on the airless sprayer system in an accessory storage area.

Another feature of the system described herein, may be that in select embodiments the spray gun may attach to a wand. The wand may be hollow throughout its length and may have a first connection end and a second connection end. The first connection end may secure the wand to the spray gun. The second connection end may connect to an attachment such as the encapsulating attachment and/or the duckbilled attachment. By implementing this optional embodiment, a user of the disclosed system may be able to remain standing during use of the airless sprayer system while waterproofing a roof. This may increase the amount of coverage a user may be capable of during a given amount of time, may increase the overall efficiency of labor when waterproofing a roof, and perhaps most importantly, relieve the user of any ergonomic issues that may develop from constantly bending and/or crouching.

In use, the disclosed system and method for use has drastically reduced the amount of labor required for waterproofing metal roofs and has relieved the repetitive motion injuries normally suffered by laborers during and after such work. Furthermore, the disclosed system and method has reduced the costs associated with completing the waterproofing of metal roof installations with respect to materials consumed in addition to cost of labor.

These and other features of the system and method of use will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

Figure 1:
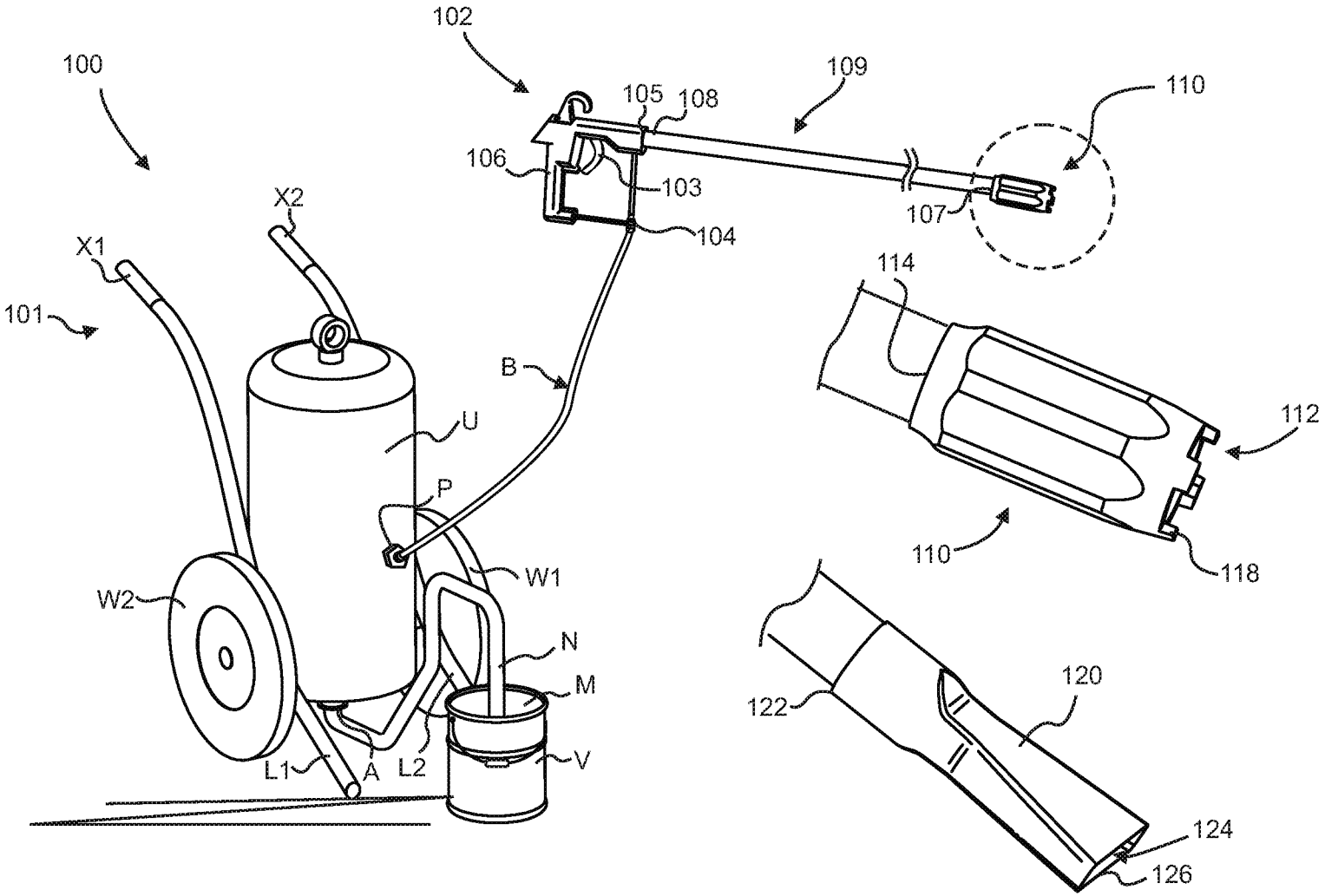
FIG. 1 is an elevation view of the disclosed airless sprayer attached to a reservoir and a spray gun having a wand and encapsulating attachment with close-up views of both the encapsulating and the duckbilled attachment.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-7, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-7 by way of example, and not limitation, therein is illustrated example embodiments of waterproofing system 100. Waterproofing system 100 may be referred herein as just system 100. System 100 may contain the basic elements of airless sprayer system 101, spray gun 102, encapsulating attachment 110, and duckbilled attachment 120. Although system 100 is shown in the drawings as connected to a wand 109 therebetween encapsulating attachment 110 and spray gun 102, the disclosure is not so limited, and system 100 may be used without wand 109. Furthermore, system 100 is shown in conjunction with reservoir V, which is illustrated as a bucket, but reservoir V may constitute any vessel which is capable of holding a liquid.

Figure 5:
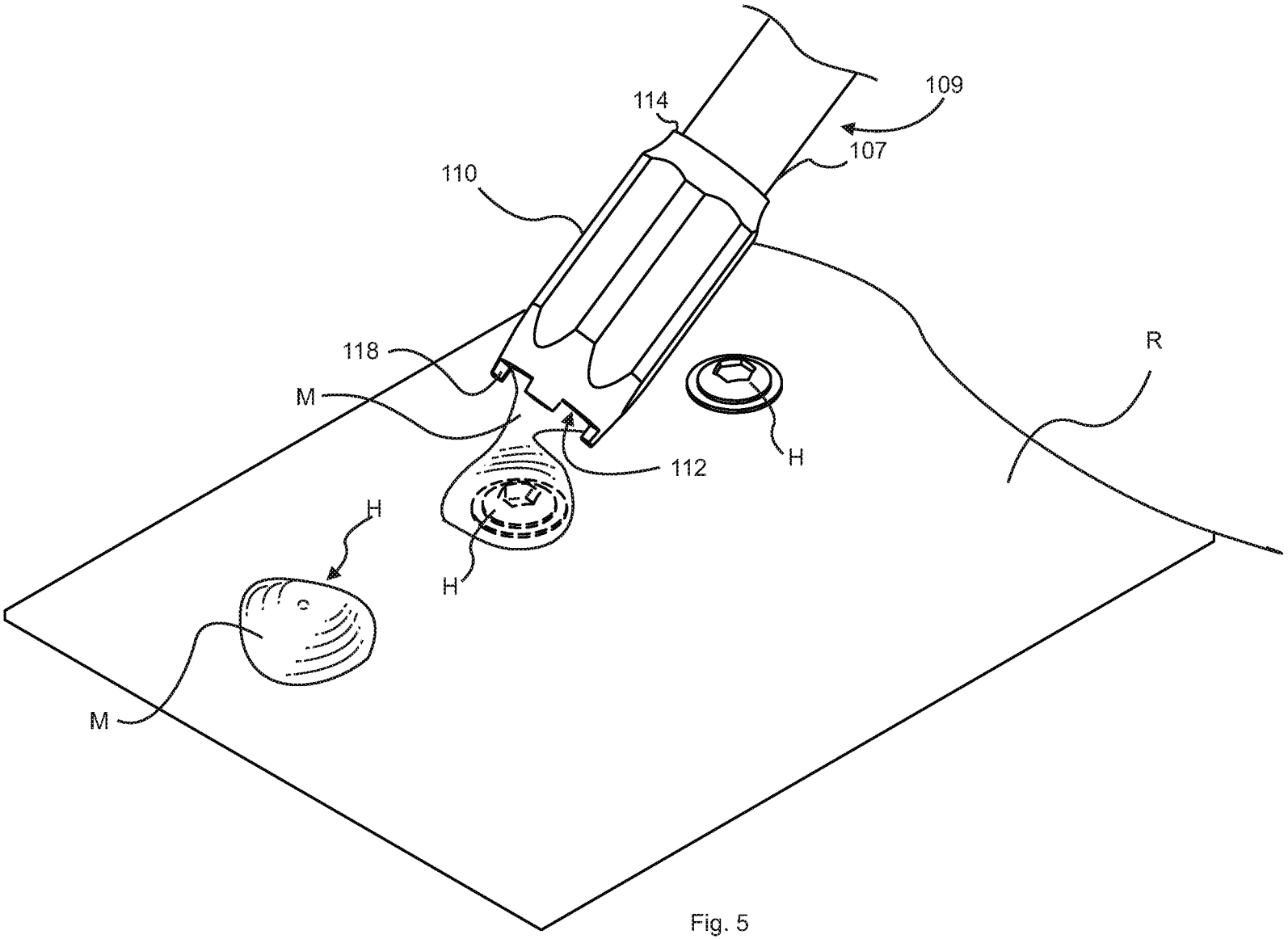
FIG. 5 is an overhead view of a roof having fastener weakness areas as waterproofing liquid is being applied to each fastener using the system with the encapsulating attachment attached.
Figure 6:
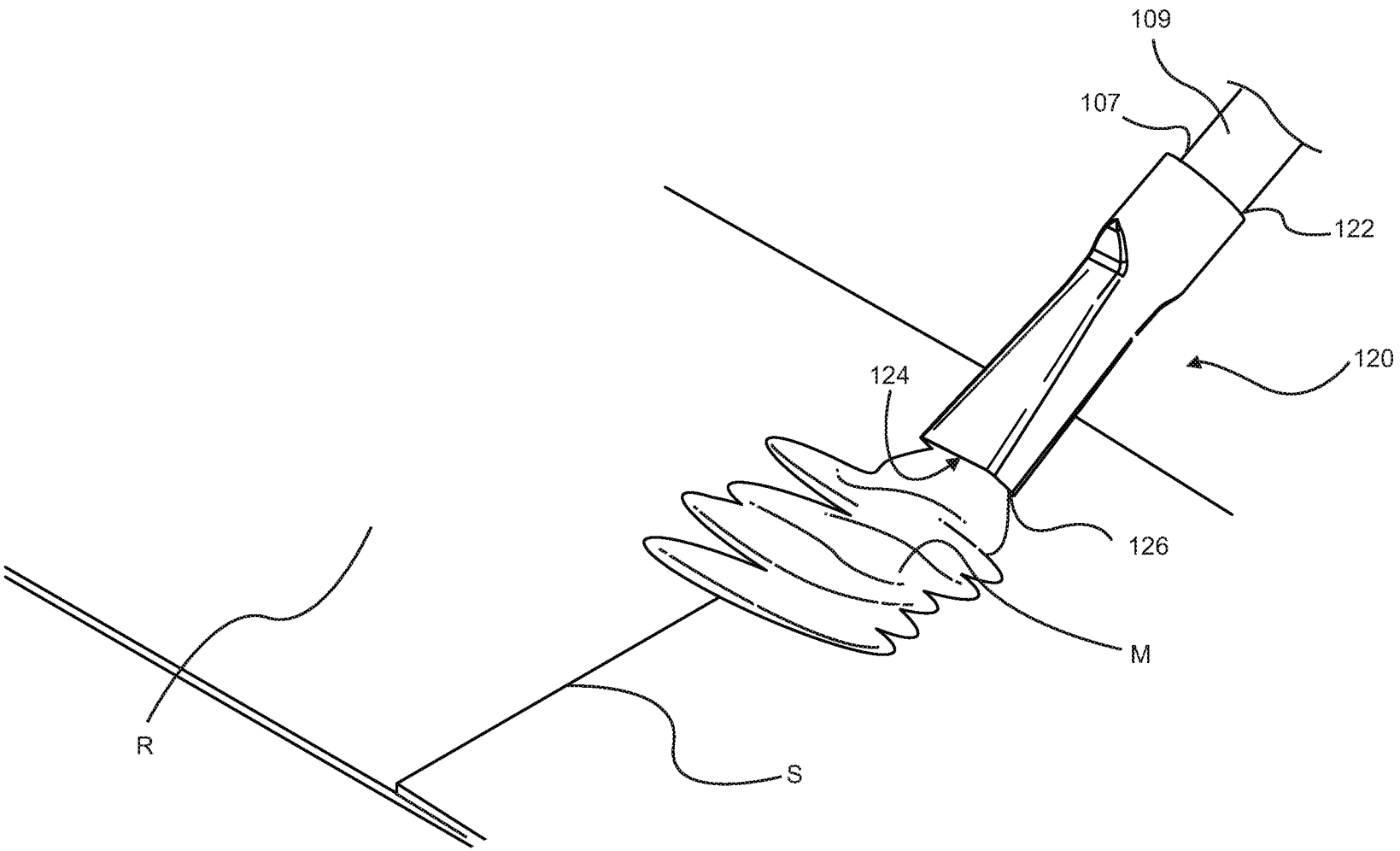
FIG. 6 is an overhead view of a roof having a seam weakness area as waterproofing liquid is being applied to the seam using the system with the duckbilled attachment attached.

In one aspect, system 100 may provide the functions of waterproofing at least two weakness areas on a metal roof R: a fastener head H (see FIG. 5) and a seam S (see FIG. 6). By combining these functions, system 100 may be more versatile, economic, ergonomic, and convenient than standard systems and methods for waterproofing roofs. Further enhancing its convenient nature, system 100 may extend via wand 109 from the portion where a user would grip upon spray gun 102 during use to either encapsulating attachment 110 or duckbilled attachment 120 which would be placed at or along a weakness portion of roof R (see FIGS. 1, 4, 5, and 6), thereby allowing the user to stand during use. System 100 may be intended as a versatile enhanced tool for professional roof waterproofers, the use of which may also appeal to any person desiring to waterproof a metal roof (i.e. a do-it-yourselfer).

By size and weight, system 100 may mostly be formed by airless sprayer system 101. Airless sprayer system 101 may provide the overall shape, size and structure of system 100. Airless sprayer system 101 may include various parts that may further enhance the overall versatility of system 100. These may include right handle X1, left handle X2, left wheel W1, right wheel W2, right stand L1, and left stand L2. These components may allow a user to easily transport airless sprayer system 101 and system 100 across distances for transport to job sites and/or along the surface of roof R during use. Other components important to airless sprayer system 101, in an order that may be relevant to the path a fluid takes within the system, may include inlet fluid hose N, fluid inlet A, pump system U (including a piston pump, a motor and drive system, a manifold filter, and a pressure dial), fluid outlet P, and outlet fluid hose B. Depending on the fuel and/or power source of airless sprayer system 101, it may further include a power adapter, a battery, and/or a fuel tank and engine, the like and/or combinations thereof. Generally, the components of airless sprayer system 101 may be flushed and/or disassembled for maintenance and cleaning, especially those components that are exposed to fluids during use.

In select embodiments, airless sprayer system 101 may include a large number of components some being critical to its operation and some being optional for various increases in performance and/or efficiency. Airless sprayer system 101 of the disclosure is not limited to any particular type or style of airless sprayer system. The desired configuration for the desired results would be known to those skilled in the art, but may include a resin pump supported on a platform which includes a fluid input port for receiving waterproofing liquid M from reservoir V. The resin pump may also include a second fluid input port for receiving air under pressure from a compressed air source and a fluid output port under pressure to spray gun 102. Various features of such a resin pump may be represented in the drawings as pump system U having fluid inlet A and fluid outlet P. While many skilled in the art may prefer a resin and/or accelerator pump powered by an air compressor, electric alternatives may be available for alternative purposes and/or desired results. Other various components well understood in the art may also be important to a functioning and well-designed airless sprayer system 101, including but not limited to suction conduits, filter(s), fluid and/or gas delivery tubes and/or hoses, support panel(s), protective bodies, supportive frames, fuel tank(s), oil reservoir(s), spark plug(s), ignition(s) and/or pull-starter(s), battery(ies), valve(s), manifold(s), handle(s), spring(s), joint(s), hinge(s), piston(s), transformer(s), electrical cord(s), wiring, wiring harness(s), pressure and/or fuel gauge(s), switch(es), sensor(s), the like, and/or combinations thereof. Importantly, these may be designed, manufactured, assembled, and/or sold using various combinations and techniques known to those skilled in the art that may offer varying degrees of performance and be more or less suitable for a given project. Considerations such as cost, weight, mobility, the like, and combinations thereof may be important to any given task. A battery-powered, electric-powered, and/or gas-powered airless sprayer system 101 may be used in the system 100 of the disclosure and may be chosen based on some, different, or all of the above considerations. Smaller, even handheld, units may be appropriate, though they may lack a sufficient reservoir V to accomplish larger jobs efficiently. Exemplary larger units capable of connecting to large reservoirs and currently available for purchase may include GRACO® MAGNUM X5 AIRLESS SPRAYER GRACO® and MAGNUM 257025 PROJECT PAINTER PLUS PAINT SPRAYER of the gas and electric variety, respectively. A smaller, battery-powered exemplary device currently available for purchase may include GRACO® ULTRA CORDLESS AIRLESS HANDHELD PAINT SPAYER 17M363.

It is contemplated herein that various improvements to system 100 may further improve its overall efficiency and effectiveness. By way of example and not limitation, a manifold may be added to fluid outlet P whereby more than one outlet fluid hose B may be attached, thereby allowing more than one spray gun 102 to be utilized, along with multiple and/or combinations of encapsulating attachment 110, wand 109, and duckbilled attachment 120, simultaneously by more than one user. Further enhancing system 100 may be increasing the potential volume of waterproofing liquid M contained within reservoir V, for instance, a 55-gallon drum. Alongside these potentially improved means for increasing the efficiency of system 100, may be the addition of additional method steps which may include increasing the pressure of airless sprayer system 101 during initial operation in order to fill outlet fluid hose B sufficiently with waterproofing liquid B, followed by the optional step of lowering the pressure of airless sprayer system 101 during operation so as to better control the amount of waterproofing liquid M which is released from system 100, upon a weakness area of roof R. It is further contemplated herein that various compounds may be preferred by those skilled in the art for waterproofing liquid M. By way of example and not limitation, compounds and/or formulas for waterproofing liquid M may include elastomeric coatings, urethane coatings, silicone coatings, the like, and/or combinations thereof, each of which may exist in various forms and formulas and may each have benefits and/or tradeoffs which are known by those skilled in the art of waterproofing roofs.

Referring specifically to FIG. 1, therein illustrated an elevation view of system 100 having closeup views of encapsulating attachment 110 and duckbilled attachment 120. Generally, system 100 may include the basic components of airless sprayer system 101 attached to reservoir V and spray gun 102 having optional wand 109 and interchangeable attachments of encapsulating attachment 110 and duckbilled attachment 120. By size and weight, system 100 may mostly be formed by airless sprayer system 101. Airless sprayer system 101 may provide the overall shape, size and structure of system 100. Airless sprayer system 101 may include various parts that may further enhance the overall versatility of system 100. These may include right handle X1, left handle X2, left wheel W1, right wheel W2, right stand L1, and left stand L2. These components may allow a user to easily transport airless sprayer system 101 and system 100 across distances for transport to job sites and/or along the surface of roof R during use. Other components important to airless sprayer system 101, in an order that may be relevant to the path a fluid takes within the system, may include inlet fluid hose N, fluid inlet A, pump system U (including a piston pump, a motor and drive system, a manifold filter, and a pressure dial), fluid outlet P, and outlet fluid hose B. Outlet fluid hose B may have a reservoir end and a connection end, the connection end may connect to airless sprayer system 101 and the reservoir end may be contacting or submerged in waterproofing liquid M contained within reservoir V. Depending on the fuel and/or power source of airless sprayer system 101, it may further include a power adapter, a battery, and/or a fuel tank and engine, the like and/or combinations thereof. Generally, the components of airless sprayer system 101 may be flushed and/or disassembled for maintenance and cleaning, especially those components that are exposed to fluids during use. System 100 may also include, in addition to airless sprayer system 101, spray gun 102, a first interchangeable attachment or encapsulating attachment 110, a second interchangeable attachment or duckbilled attachment 120, and optional wand 109.

In select embodiments, system 100 may also include spray gun 102. Generally, spray gun 102 may generally feature gun outlet connection 105, gun inlet connection 104, gun handle 106, and gun trigger 103. Waterproofing fluid M may travel through spray gun 102 starting at gun inlet connection 104 when gun trigger 103 is squeezed by the user. Waterproofing fluid M may then exit through the remainder of system 100 via gun outlet connection 105. Spray gun 102 may be held by a user at gun handle 106. Wand 109, encapsulating attachment 110, and/or duckbilled attachment 120 may connect to spray gun 102 at wand inlet end and gun outlet connection 105 through a variety of means, including but not limited to threading, friction, magnetism, clamping, the like and/or combinations thereof. Spray gun 102 may preferably be comprised of a number of components and/or subcomponents, each may be manufactured from a variety of materials, including but not limited to metals, plastics, rubber or other natural materials, composite materials, the like and/or combinations thereof.

In select embodiments, system 100 may also include encapsulating attachment 110. Generally, encapsulating attachment 110 may feature cavity end 112, encapsulating connection end 114, bottom surface 118, and inner cavity 116 or may be understood to have an inner surface and an outer surface having one or more cavity and attachment sections and/or ends. As illustrated, encapsulating attachment 110 may be substantially cylindrical on its outer surface or may have notch grips to allow for increased leverage when detaching from system 100. Encapsulating attachment 110 may connect to system 100 through a variety of means, including but not limited to threading, friction, magnetism, clamping, the like and/or combinations thereof. As illustrated, encapsulating attachment 110 may be threaded at encapsulating connection end 114, though any means of securing encapsulating attachment 110 to system 100 may suffice. Importantly, encapsulating attachment may be hollow throughout, having an opening at encapsulating connection end 114 and cavity end 112 with inner cavity 116 therebetween, thereby allowing fluid to pass out of system 100 onto roof R. Encapsulating attachment 110 may be optionally notched at bottom surface 118 which may allow a user to press more firmly upon roof R and simultaneously allowing gas to escape system 100 while allowing the user to monitor when sufficient waterproofing liquid M has been applied to fastener H, or the exposed head of fastener H protruding from the surface of roof R. When sufficient waterproofing liquid M has covered fastener H, waterproofing liquid may begin to be visible escaping through notched openings along bottom surface 118. Encapsulating attachment 110 may be manufactured from a variety of materials, including but not limited to metals, plastics, rubber or other natural materials, composite materials, the like and/or combinations thereof.

In select embodiments, system 100 may also include duckbilled attachment 120. Generally, duckbilled attachment 120 may include duckbill connection end 122 and rectangular end 124 having rectangular opening 126 or may be understood to have an inner surface and an outer surface having one or more cavity and attachment sections and/or ends. As illustrated, duckbill connection end 122 may be substantially cylindrical so as to allow connection to wand 109 or spray gun 102. Duckbilled attachment 120 may flatten and/or narrow in one direction and flatten and/or widen in another direction to form rectangular end 124. Duckbilled attachment 120 may connect to system 100 through a variety of means, including but not limited to threading, friction, magnetism, clamping, the like and/or combinations thereof. As illustrated, duckbilled attachment 120 may be friction-based at duckbill connection end 122 or may optionally use a ring clamp (not shown) for increased security, though any means of securing duckbilled attachment 120 to system 100 may suffice. Importantly, duckbilled attachment may be hollow throughout, having an opening at duckbill connection end 122 and rectangular end 124 and rectangular opening 126 forming a cavity therebetween, thereby allowing fluid to pass out of system 100 onto roof R. Duckbilled attachment 120 may be optionally tapered along its surface. Duckbilled attachment 120 may be manufactured from a variety of materials, including but not limited to metals, plastics, rubber or other natural materials, composite materials, the like and/or combinations thereof.

In select optional embodiments, system 100 may feature optional wand 109 as an extension between spray gun 102 and either encapsulating attachment 110 or duckbilled attachment 120. Wand 109 may be understood as an accessory to prevent a user of system 100 from needing to unnecessarily crouch or bend over during use of system 100 on roof R. By installing wand 109, a user of system 100 may be able to complete waterproofing work upon roof R while standing, which may increase the overall ergonomic performance of system 100. Generally, optional wand 109 may contain a wand inlet end 108 and a wand outlet end 107. Wand 109 may connect to spray gun 102 at wand inlet end and gun outlet connection 105 through a variety of means, including but not limited to threading, friction, magnetism, clamping, the like and/or combinations thereof. Wand 109 may be cylindrically shaped, be hollow throughout, and manufactured from a variety of materials, including but not limited to metals, plastics, rubber or other natural materials, composite materials, the like and/or combinations thereof. The hollow cavity within wand 109 may allow waterproofing fluid M flow through wand 109 as described above. After having traveled through wand 109, waterproofing fluid M may flow out wand 109 and through wand outlet end 107 which may be capable of receiving either duckbilled attachment 120 or encapsulating attachment 110 at duckbill connection end 122 or encapsulating connection end 114, respectively, and continue to flow out of system 100 onto roof R. Wand 109 may be manufactured in various shapes and sizes and may include such features such as a bend, an angle, a curve, the like and/or combinations thereof as would be understood by those skilled in the art to increase the ergonomic or other features of wand 109 and thereby system 100.

Figure 2:
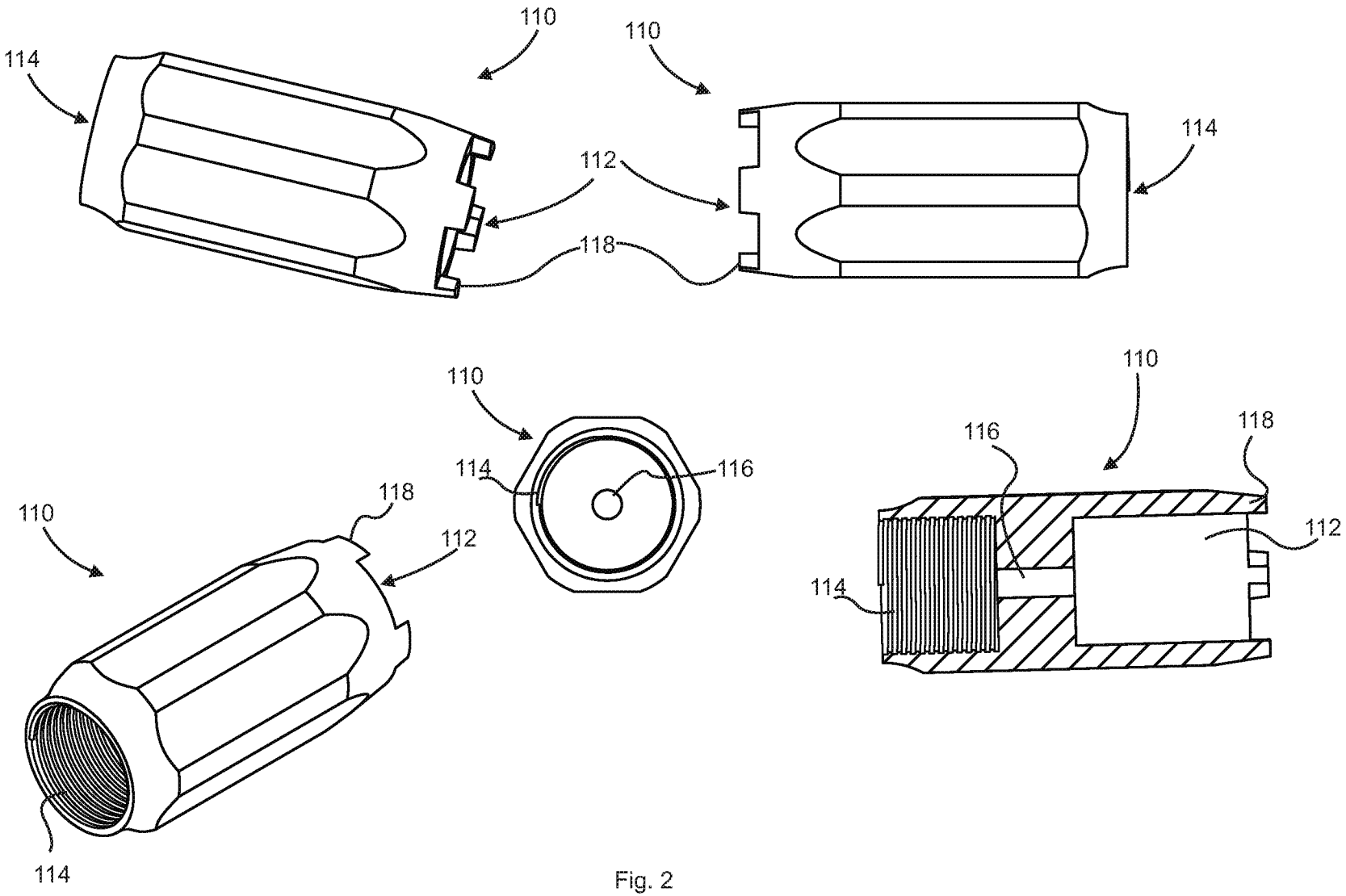
FIG. 2 is a close-up view of the encapsulating attachment from various angles, including a cutaway cross-sectional view.

Referring specifically to FIG. 2, therein illustrated are close-up views of encapsulating attachment 110 from various angles. Generally, encapsulating attachment 110 may feature cavity end 112, encapsulating connection end 114, bottom surface 118, and inner cavity 116. As illustrated, encapsulating attachment 110 may be substantially cylindrical on its outer surface or may have notch grips to allow for increased leverage when detaching from system 100. Encapsulating attachment 110 may connect to system 100 through a variety of means, including but not limited to threading, friction, magnetism, clamping, the like and/or combinations thereof. As illustrated, encapsulating attachment 110 may be threaded at encapsulating connection end 114, though any means of securing encapsulating attachment 110 to system 100 may suffice. Importantly, encapsulating attachment may be hollow throughout, having an opening at encapsulating connection end 114 and cavity end 112 with inner cavity 116 therebetween, thereby allowing fluid to pass out of system 100 onto roof R. Encapsulating attachment 110 may be optionally notched at bottom surface 118 which may allow a user to press more firmly upon roof R and simultaneously allowing gas to escape system 100 while allowing the user to monitor when sufficient waterproofing liquid M has been applied to fastener H. When sufficient waterproofing liquid M has covered fastener H, waterproofing liquid may begin to be visible escaping through notched openings along bottom surface 118. Encapsulating attachment 110 may be manufactured from a variety of materials, including but not limited to metals, plastics, rubber or other natural materials, composite materials, the like and/or combinations thereof.

Figure 3:
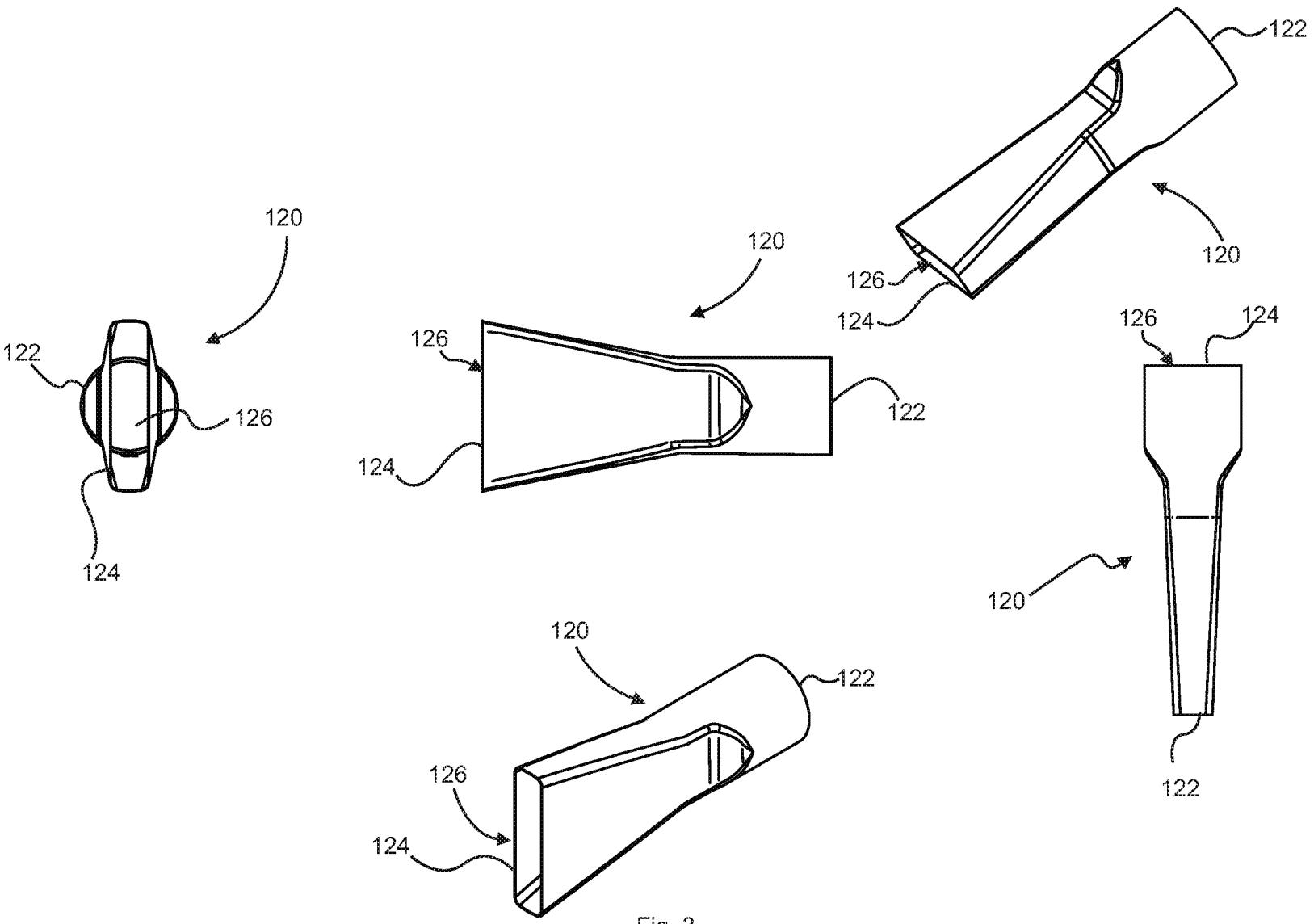
FIG. 3 is a close-up view of the duckbilled attachment from various angles.

Referring specifically to FIG. 3, therein illustrated are close-up views of duckbilled attachment 120 from various angles. Generally, duckbilled attachment 120 may include duckbill connection end 122 and rectangular end 124 having rectangular opening 126. As illustrated, duckbill connection end 122 may be substantially cylindrical so as to allow connection to wand 109 or spray gun 102. Duckbilled attachment 120 may flatten and/or narrow in one direction and flatten and/or widen in another direction to form rectangular end 124. Duckbilled attachment 120 may connect to system 100 through a variety of means, including but not limited to threading, friction, magnetism, clamping, the like and/or combinations thereof. As illustrated, duckbilled attachment 120 may be friction-based at duckbill connection end 122 or may optionally use a ring clamp (not shown) for increased security, though any means of securing duckbilled attachment 120 to system 100 may suffice. Importantly, duckbilled attachment may be hollow throughout, having an opening at duckbill connection end 122 and rectangular end 124 and rectangular opening 126 forming a cavity therebetween, thereby allowing fluid to pass out of system 100 onto roof R. Duckbilled attachment 120 may be optionally tapered along its surface. Duckbilled attachment 120 may be manufactured from a variety of materials, including but not limited to metals, plastics, rubber or other natural materials, composite materials, the like and/or combinations thereof.

Figure 4:
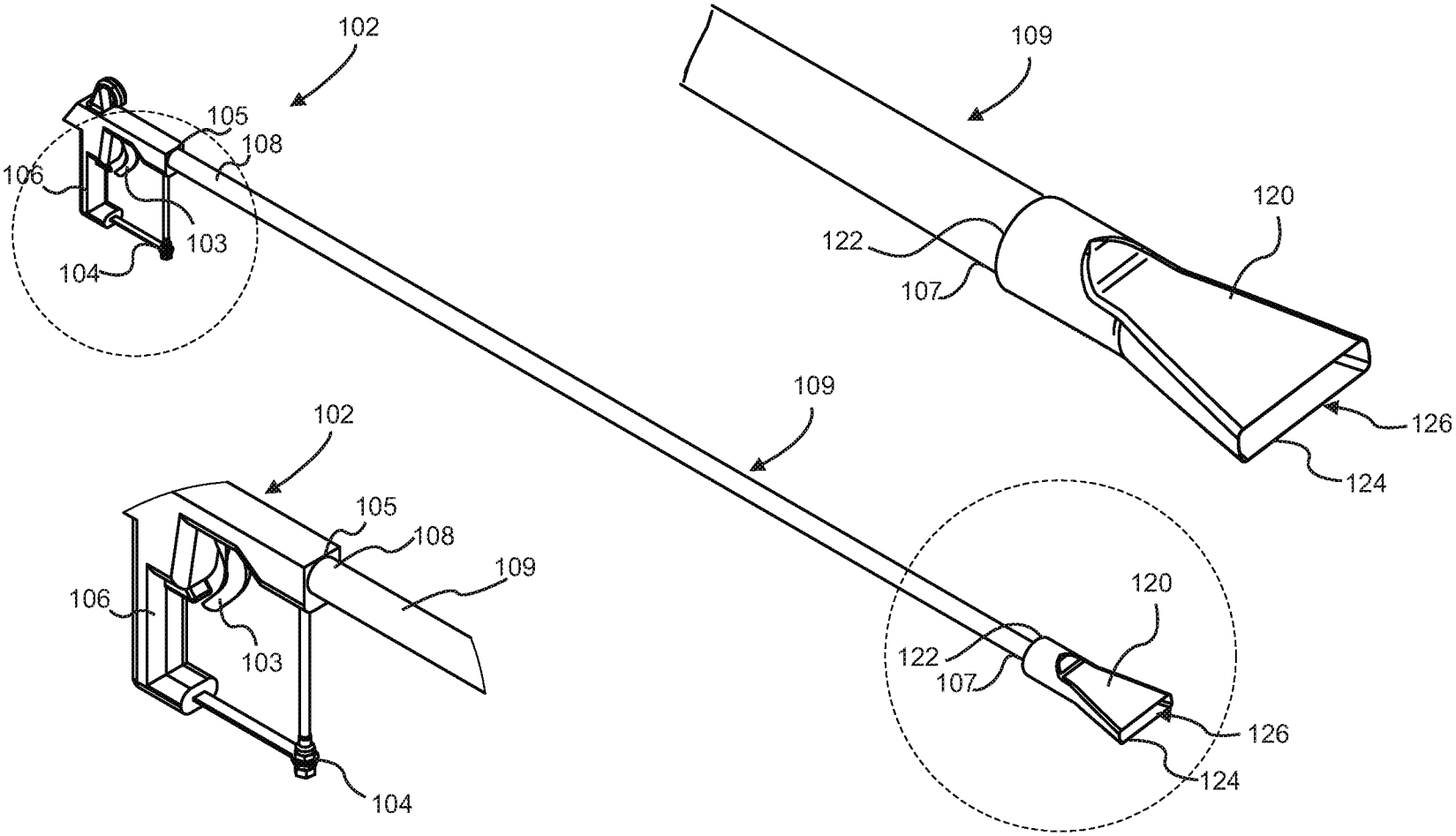
FIG. 4 is a top-angle view of the spray gun attached to a wand and a duckbilled attachment, featuring close-up views of both the spray gun and the duckbilled attachment.

Referring specifically to FIG. 4, therein illustrated is a top-angle view of spray gun 102 attached to wand 109 and duckbilled attachment 120, featuring closeup views of both spray gun 102 and duckbilled attachment 120. Starting with spray gun 102, it may generally feature gun outlet connection 105, gun inlet connection 104, gun handle 106, and gun trigger 103. Waterproofing fluid M may travel through spray gun 102 starting at gun inlet connection 104 when gun trigger 103 is squeezed by the user. Waterproofing fluid M may then exit through the remainder of system 100 via gun outlet connection 105. Spray gun 102 may be held by a user at gun handle 106. Next, optional wand 109 may contain a wand inlet end 108 and a wand outlet end 107. Wand 109 may connect to spray gun 102 at wand inlet end and gun outlet connection 105 through a variety of means, including but not limited to threading, friction, magnetism, clamping, the like and/or combinations thereof. Wand 109 may be cylindrically shaped, be hollow throughout, and manufactured from a variety of materials, including but not limited to metals, plastics, rubber or other natural materials, composite materials, the like and/or combinations thereof. The hollow cavity within wand 109 may allow waterproofing fluid M flow through wand 109 as described above. After having traveled through wand 109, waterproofing fluid M may flow out wand 109 and through wand outlet end 107 which may be capable of receiving either duckbilled attachment 120 or encapsulating attachment 110 at duckbill connection end 122 or encapsulating connection end 114, respectively, and continue to flow out of system 100 onto roof R. Wand 109 may be manufactured in various shapes and sizes and may include such features such as a bend, an angle, a curve, the like and/or combinations thereof as would be understood by those skilled in the art to increase the ergonomic or other features of wand 109 and thereby system 100. Wand 109 may be manufactured from a variety of materials, including but not limited to metals, plastics, rubber or other natural materials, composite materials, the like and/or combinations thereof. Duckbilled attachment 120 may include duckbill connection end 122 and rectangular end 124 having rectangular opening 126. As illustrated, duckbill connection end 122 may be substantially cylindrical so as to allow connection to wand 109 or spray gun 102. Duckbilled attachment 120 may flatten and/or narrow in one direction and flatten and/or widen in another direction to form rectangular end 124. Duckbilled attachment 120 may connect to system 100 through a variety of means, including but not limited to threading, friction, magnetism, clamping, the like and/or combinations thereof. As illustrated, duckbilled attachment 120 may be friction-based at duckbill connection end 122 or may optionally use a ring clamp (not shown) for increased security, though any means of securing duckbilled attachment 120 to system 100 may suffice. Importantly, duckbilled attachment may be hollow throughout, having an opening at duckbill connection end 122 and rectangular end 124 and rectangular opening 126 forming a cavity therebetween, thereby allowing fluid to pass out of system 100 onto roof R. Duckbilled attachment 120 may be optionally tapered along its surface. Duckbilled attachment 120 may be manufactured from a variety of materials, including but not limited to metals, plastics, rubber or other natural materials, composite materials, the like and/or combinations thereof.

Referring specifically to FIG. 5, therein illustrated is an overhead view of roof R having fastener H as waterproofing liquid M is being applied to each fastener H using system 100 with encapsulating attachment 110 attached. Generally, encapsulating attachment 110 may feature cavity end 112, encapsulating connection end 114, bottom surface 118, and inner cavity 116. As illustrated, encapsulating attachment 110 may be substantially cylindrical on its outer surface or may have notch grips to allow for increased leverage when detaching from system 100. Encapsulating attachment 110 may connect to system 100 through a variety of means, including but not limited to threading, friction, magnetism, clamping, the like and/or combinations thereof. As illustrated, encapsulating attachment 110 may be threaded at encapsulating connection end 114, though any means of securing encapsulating attachment 110 to system 100 may suffice. Importantly, encapsulating attachment may be hollow throughout, having an opening at encapsulating connection end 114 and cavity end 112 with inner cavity 116 therebetween, thereby allowing fluid to pass out of system 100 onto roof R. Encapsulating attachment 110 may be optionally notched at bottom surface 118 which may allow a user to press more firmly upon roof R and simultaneously allowing gas to escape system 100 while allowing the user to monitor when sufficient waterproofing liquid M has been applied to fastener H. When sufficient waterproofing liquid M has covered fastener H, waterproofing liquid may begin to be visible escaping through notched openings along bottom surface 118. Encapsulating attachment 110 may be manufactured from a variety of materials, including but not limited to metals, plastics, rubber or other natural materials, composite materials, the like and/or combinations thereof.

Referring specifically to FIG. 6, therein illustrated is an overhead view of roof R having seam S weakness area as waterproofing liquid M is being applied to seam S using system 100 with duckbilled attachment 120 attached. Seam S may exist at any roofing portion where at least two roofing sections meet, namely where a corrugated metal panel meets another corrugated metal panel upon an upper surface of a building. It is also contemplated that a seam could be any long narrow section of a roof where the possibility exists that water may enter an interior portion of a building without sufficient waterproofing barrier. By example and not limitation, seams may exist where a roof and a window meet, where a roof and a skylight meet, where a roof and a gutter meet, where a roof and an exposed portion of a joist meet, the like, and/or combinations thereof. Generally, duckbilled attachment 120 may include duckbill connection end 122 and rectangular end 124 having rectangular opening 126. As illustrated, duckbill connection end 122 may be substantially cylindrical so as to allow connection to wand 109 or spray gun 102. Duckbilled attachment 120 may flatten and/or narrow in one direction and flatten and/or widen in another direction to form rectangular end 124. Duckbilled attachment 120 may connect to system 100 through a variety of means, including but not limited to threading, friction, magnetism, clamping, the like and/or combinations thereof. As illustrated, duckbilled attachment 120 may be friction-based at duckbill connection end 122 or may optionally use a ring clamp (not shown) for increased security, though any means of securing duckbilled attachment 120 to system 100 may suffice. Importantly, duckbilled attachment may be hollow throughout, having an opening at duckbill connection end 122 and rectangular end 124 and rectangular opening 126 forming a cavity therebetween, thereby allowing fluid to pass out of system 100 onto roof R. Duckbilled attachment 120 may be optionally tapered along its surface. Duckbilled attachment 120 may be manufactured from a variety of materials, including but not limited to metals, plastics, rubber or other natural materials, composite materials, the like and/or combinations thereof. As illustrated herein, as waterproofing liquid M passes out of system 100 at rectangular opening 126, it may leave a broad area along each side of seam S so as to provide broad coverage of the weakness area. Optionally, a further step in the disclosed method may include following up with a brush and/or roller to thin or spread waterproofing liquid M in a more uniform or broader area, thereby possibly increasing the adhesion of waterproofing liquid M to roof R at seam S and increasing the aesthetic look of roof R. During and/or after installation of waterproofing liquid M on seam S, the effect may appear as a long bead of waterproofing liquid M along the length of seam S. One skilled in the art of waterproofing a roof would know a width sufficient to protect seam S with waterproofing liquid M or know the sufficient width to create the intended effect. This width may be one inch or wider, the wider the bead of waterproofing liquid M, the greater the amount of waterproofing liquid M would be required to accomplish the intended effect. Varying widths of duckbilled attachment 120 may accomplish varying widths to either side of seam S.

Figure 7:
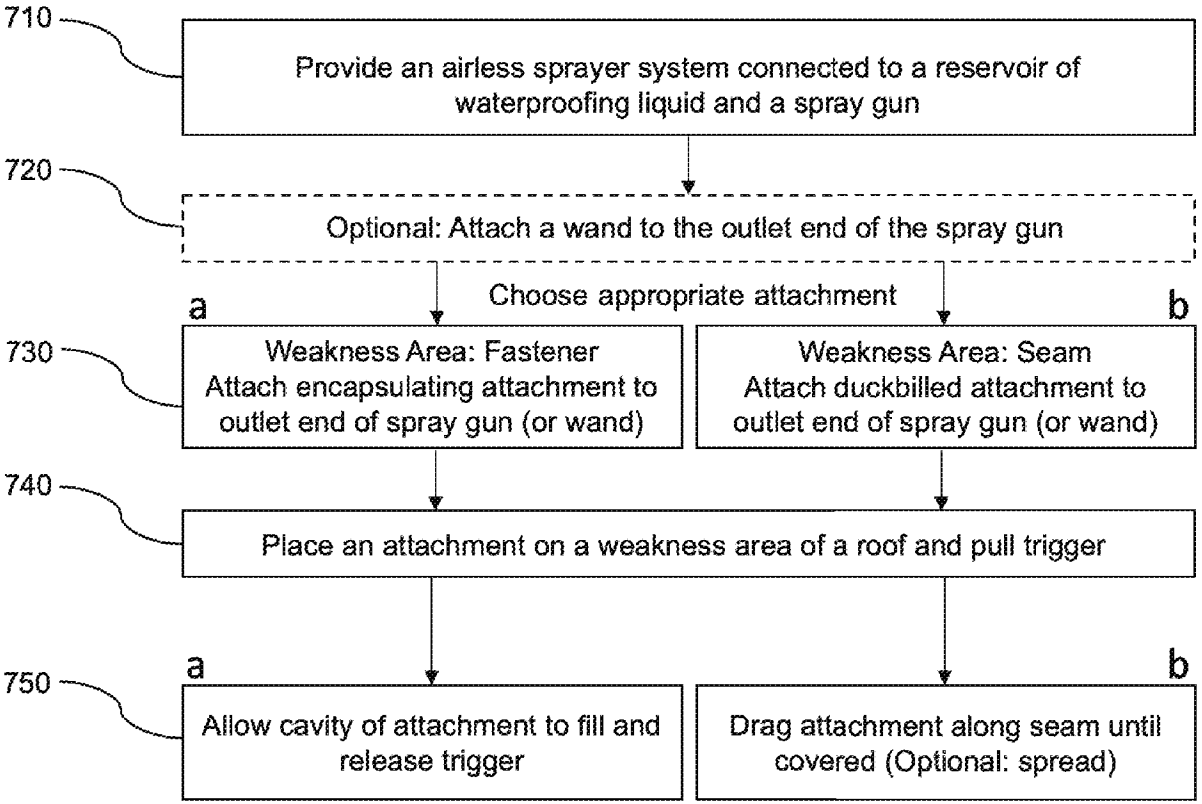
FIG. 7 is a flow chart of an exemplary method of use of the disclosed system.

Referring specifically to FIG. 7, therein is illustrated a flow chart of an exemplary method of use of system 100. At step 710, airless sprayer system 101 is provided and connected to reservoir V and spray gun 102. Optionally, at step 720, wand 109 may be attached to gun outlet connection 105 of spray gun 102. Next, prior to step 730, a user may choose the appropriate connection of system 100 for the weakness area of roof R which she may intend to waterproof using waterproofing liquid M. If the weakness area is fastener H, an appropriate choice may be step 730*a*, or attaching encapsulating attachment 110 to either wand 109 or gun outlet connection 105. Alternatively, if the weakness area is seam S, an appropriate choice may be step 730*b*, or attaching duckbilled attachment 120 to wand 109 or gun outlet connection 105. Next, at step 740, the user would place either encapsulating attachment 110 or duckbilled attachment 120 upon weakness area, fastener H or seam S, respectively. As described in more detail above, at step 750*a*, a user may pull gun trigger 103, allow cavity end 112 to fill with waterproofing liquid M, and release gun trigger 103, thus having covered fastener H with sufficient waterproofing liquid M. As described in more detail above, at step 750*b*, a user may pull gun trigger 103 and drag attachment along seam S until covered and optionally spread the material after release of gun trigger 103 using a brush, roller, the like and/or combinations thereof.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A system for waterproofing a weakness area of a metal roof comprising:

an airless sprayer system;

a reservoir containing a waterproofing liquid; and an encapsulating attachment, said encapsulating attachment comprising a connection end configured to connect to said airless sprayer system, and a cavity end, said cavity end having a circular opening opposite said connection end and configured to engage the weakness area during waterproofing, said circular opening is notched toward said connection end to form a plurality of voids therebetween said cavity end and the weakness area;

wherein said encapsulating attachment is of sufficient size to cover the weakness area at said cavity end thereby fully covering the weakness area with said waterproofing liquid upon a pulling and a release of a trigger of said airless sprayer system.

2. The system of claim 1, wherein the encapsulating attachment is threaded at said connection end.

3. The system of claim 2, wherein the cavity end is of a sufficient size to surround a roof fastener head.

4. The system for of claim 1, wherein said reservoir connected to said airless sprayer system via a hose, the hose having a reservoir end and a connection end, the connection end capable of connecting to an inlet of said airless sprayer system.

5. The system of claim 1, wherein the weakness area is an area of the metal roof where at least two metal panels meet.

6. The system of claim 5, wherein at said area of the metal roof where said at least two metal panels meet are an at least one seam and an at least one fastener, said at least one fastener having an exposed head on a surface of the metal roof.

7. The system of claim 6, wherein said cavity end is of sufficient circumference to surround said at least one fastener and of sufficient depth to contact said surface of the metal roof when surrounding said fastener.

8. The system of claim 1, wherein said airless sprayer system comprises:

a spray gun, said spray gun having said trigger and a connection end capable of accepting said encapsulating attachment.

9. The system of claim 8, wherein said attachment attaches to said spray gun therebetween the connection end of the encapsulating attachment and the connection end of the spray gun.

10. The system of claim 9, further comprising a wand capable of connecting to said spray gun and said encapsulating attachment.

11. A method for waterproofing a weakness area of a metal roof comprising:

providing an airless sprayer system connected at an outlet end with a first hose connected to a spray gun with a connection outlet end, said airless sprayer system connected at an inlet end to a reservoir containing a waterproofing fluid;

connecting an encapsulating attachment to said airless sprayer system at said connection outlet end of said spray gun, said encapsulating attachment comprising a connection end configured to connect to said airless sprayer system, and a cavity end, said cavity end having a circular opening opposite said connection end and configured to engage the weakness area during waterproofing, said circular opening is notched toward said connection end to form a plurality of voids therebetween said cavity end and the weakness area;

placing said encapsulating attachment on said weakness area of the metal roof;

pulling a trigger of said spray gun to release said waterproofing fluid upon said weakness area; and releasing said trigger of said spray gun when said weakness area is sufficiently covered with said waterproofing fluid.

12. The method of claim 11, wherein the attachment is an encapsulating attachment, said cavity end having said substantially cylindrical shape and the weakness area is a fastener head of a fastener, said fastener connecting a metal sheet to a top portion of a building.

13. The method of claim 11, wherein the attachment is a duckbilled attachment, said cavity end having said substantially rectangular shape and the weakness area is a seam, said seam is a portion of the roof where a first metal sheet and a second metal sheet overlap on the roof.

14. The method of claim 13, further comprising the step of dragging the attachment along said seam prior to releasing said trigger.

15. A system for waterproofing a weakness area of a metal roof comprising:

an airless sprayer system configured to connect to a fluid inlet connected to a fluid inlet hose, a fluid outlet connected to a fluid outlet hose, and a spray gun having a connection end configured to accept an encapsulating attachment and connected to said fluid outlet hose, said encapsulating attachment comprising a connection end configured to connect to said airless sprayer system, and a cavity end, said cavity end having a circular opening opposite said connection end and configured to engage the weakness area during waterproofing, said circular opening is notched toward said connection end to form a plurality of voids therebetween said cavity end and the weakness area;

a trigger;

a reservoir containing a waterproofing liquid connected to said airless sprayer system at said fluid inlet hose;

wherein said encapsulating attachment is of sufficient size to cover the weakness area at said cavity end thereby fully covering the weakness area with said waterproofing liquid upon a pulling and a release of said trigger of said airless sprayer system.

16. The system of claim 15, wherein the weakness area is a fastener securing the metal roof and said encapsulating attachment is configured with said cavity end being of a sufficient size to surround a roof fastener head at a bottom surface near said cavity end, said cavity end is notched.

* * * * *